US007322808B2

(12) United States Patent
Daigre

(10) Patent No.: US 7,322,808 B2
(45) Date of Patent: Jan. 29, 2008

(54) BALANCING PLATE—SHUTTLE BALL

(75) Inventor: Richard Daigre, Hopkinsville, KY (US)

(73) Assignee: White Drive Products, Inc., Hopkinsville, KY (US)

( * ) Notice: Subject to any disclaimer, the term of this patent is extended or adjusted under 35 U.S.C. 154(b) by 164 days.

(21) Appl. No.: 11/131,505

(22) Filed: May 18, 2005

(65) Prior Publication Data

US 2006/0263229 A1 Nov. 23, 2006

(51) Int. Cl.
*F01C 1/02* (2006.01)
*F01C 1/063* (2006.01)

(52) U.S. Cl. ..... 418/61.3; 418/132; 418/133; 418/270

(58) Field of Classification Search ..... 418/61.3, 418/132, 133, 270
See application file for complete search history.

(56) References Cited

U.S. PATENT DOCUMENTS 3,657,903 A * 4/1972 Woodling ..... 418/61.3
3,658,450 A * 4/1972 Woodling ..... 418/61.3
3,692,440 A * 9/1972 Woodling ..... 418/61.3
3,894,821 A * 7/1975 White, Jr. ..... 418/133
4,717,320 A * 1/1988 White, Jr. ..... 418/61.3
4,877,383 A * 10/1989 White, Jr. ..... 418/61.3
4,976,594 A * 12/1990 Bernstrom ..... 418/61.3
5,080,567 A * 1/1992 White, Jr. ..... 418/61.3
5,173,043 A * 12/1992 White, Jr. ..... 418/61.3
5,385,351 A * 1/1995 White ..... 277/572
5,624,248 A * 4/1997 Kassen et al. ..... 418/61.3
5,860,791 A * 1/1999 Kikuchi ..... 417/310
6,257,853 B1 * 7/2001 White ..... 418/61.3
6,394,775 B1 * 5/2002 White ..... 418/61.3
6,743,003 B2 * 6/2004 Dong ..... 418/61.3

* cited by examiner

*Primary Examiner*—Thomas Denion
*Assistant Examiner*—Douglas J. Duff
(74) *Attorney, Agent, or Firm*—Fay Sharpe LLP

(57) ABSTRACT

A pressure compensation mechanism for a gerotor motor is disclosed, which mechanism includes a shuttle valve that selectively interconnects either port to a single pressure chamber and thus to compensate for any pressure-induced imbalances in the device.

25 Claims, 6 Drawing Sheets

BALANCING PLATE—SHUTTLE BALL

FIELD TO WHICH THE INVENTION RELATES

This present invention relates to a pressure compensating mechanism for a pressure loaded rotary mechanism. The invention will be described in its preferred embodiment of a bidirectional shuttle valve for a gerotor type motor.

BACKGROUND OF THE INVENTION

Gerotor motors have pressure imbalances. These imbalances typically are caused by the selective pressurization of the gerotor cells utilized therein as well as the pressurization of the device necessitated by the interconnection thereof to operating ports, typically pressure and return. This is true whether the device has a rotor valve, separate rotating valve, separate orbiting valve, or otherwise. Over the years gerotor motors have modified in view of this pressure imbalance. Examples of motors together with a pressure compensating mechanism include White U.S. Pat. No. 4,717,320 entitled Gerotor Motor Balancing Plate; White U.S. Pat. No. 4,940,401 entitled Lubrication Fluid Circulation Using A Distance Valve Pump With A Bidirectional Flow; White U.S. Pat. No. 6,074,188 entitled Multiplate Hydraulic Motor Valve; and, Bernstrom U.S. Pat. No. 4,976,594 entitled Gerotor Motor And Improved Pressure Balancing Therefor. (See also White U.S. Pat. No. 6,257,853 entitled Hydraulic Motor With Pressure Compensating Manifold.) Each one of these devices in some way compensate for the different pressurization therein: In quick generality, U.S. Pat. No. 4,717,320 by bowing a balancing plate back against the rotor; U.S. Pat. No. 4,940,401 by including a piston valve to move fluid bidirectionally in and out of the internal cavity; and, U.S. Pat. No. 6,074,188 by including check balls to provide for the unimpeded laminar flow to the passage having least pressure. The U.S. Pat. No. 6,257,853 patent is a rear-ported device which includes a pressure compensating plate between the manifold and port plate; and, Bernstrom U.S. Pat. No. 4,976,594 includes a stationary valve member which biases the star member in respect to the stationary valve member.

Each of these motors is in its own way quite complex in both design, manufacture, and operation. In addition, due to delays in pressurizations, there is a corresponding delay in the operation of most of these devices. This is specially critical in low-speed low-volume high-torque operations and on direction change.

SUMMARY OF THE INVENTION

This invention relates to a simple, non-chattering balancing mechanism for hydraulic pressure devices.

OBJECT OF THE INVENTION

It is an object of this present invention to provide for a reliable pressure compensating mechanism for a rotary motor;

It is a further object of the invention to reduce flow induced chattering of a pressure compensating mechanism;

It is an additional objection of this invention to improve the low-speed/low-volume operation of gerotor motors;

It is another object of this invention to increase the volumetric efficiency of gerotor motors;

It is a further object of this invention to lower the cost of hydraulic motors;

It is an yet a further object of this invention to increase the efficiency of gerotor motors;

It is an additional objection of this invention to lower the complexity of gerotor motors;

Other objects of the invention and a more complete understanding of the invention may be had referring to the drawings within this application in which:

DETAILED DESCRIPTION OF THE INVENTION

Figure 1:
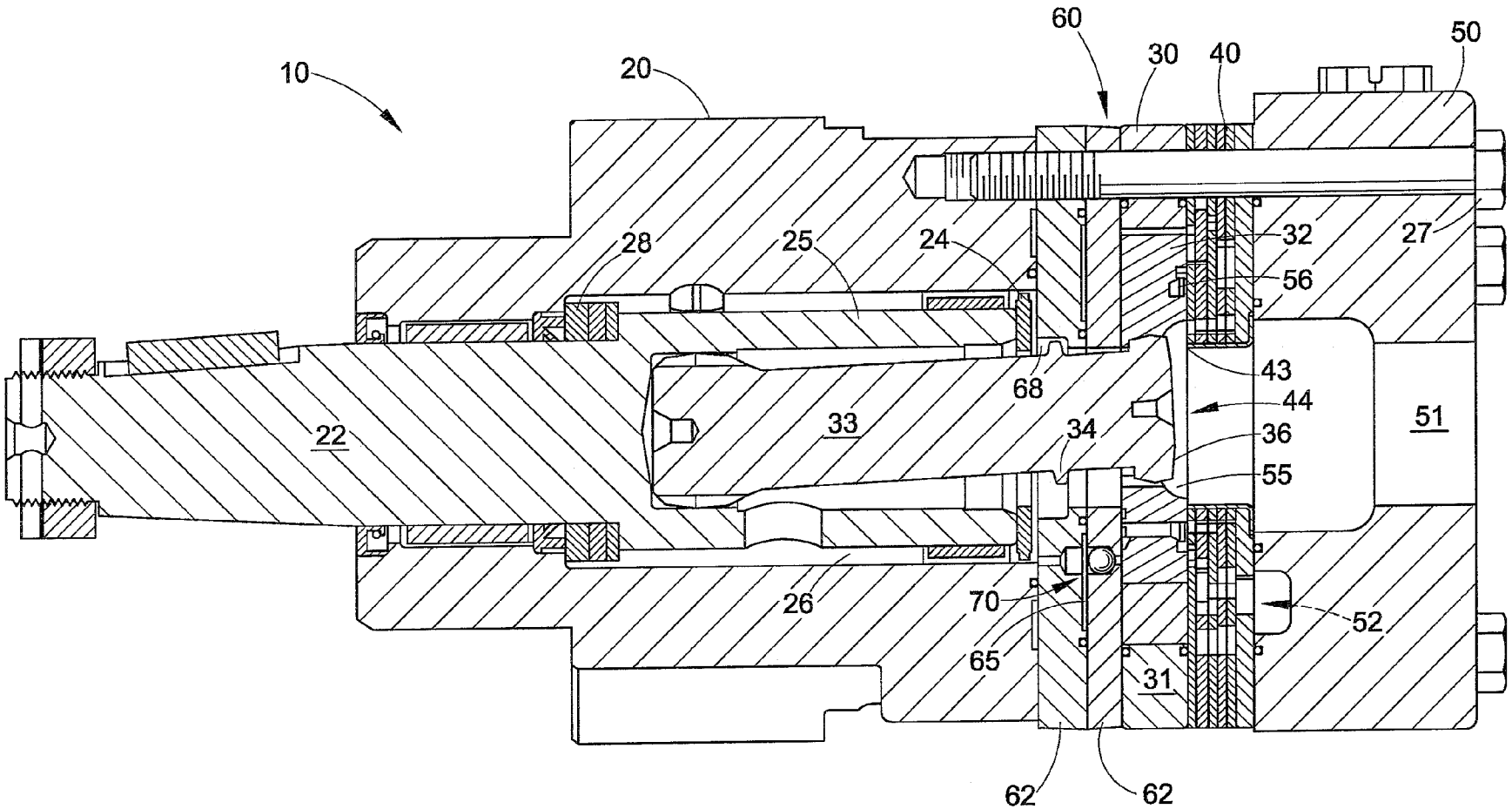
FIG. 1 is a longitudinal cross sectional view of a hydraulic device incorporating a preferred embodiment of the present invention, the shuttle ball is darkened in this figure for clarity.
Figure 2:
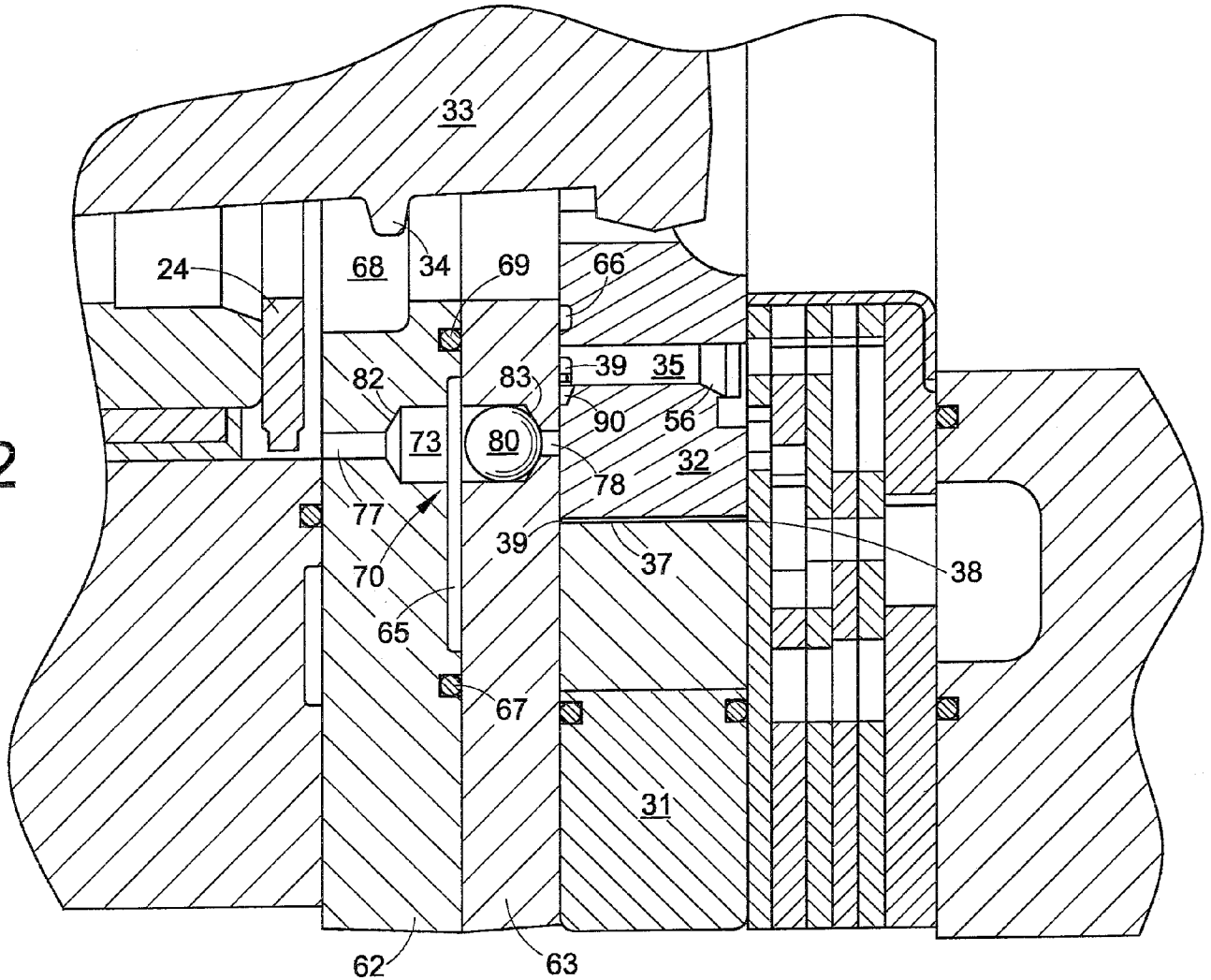
FIG. 2 is an enlarged view of a section of the balancing mechanism of FIG. 1.
Figure 5:
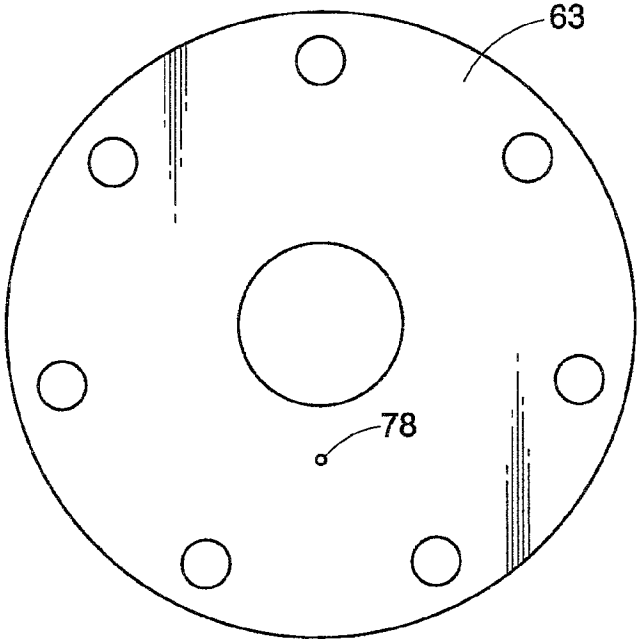
FIG. 5 is an end view of the plate of FIG. 1 taken generally along lines 5-5 therein.
Figure 3:
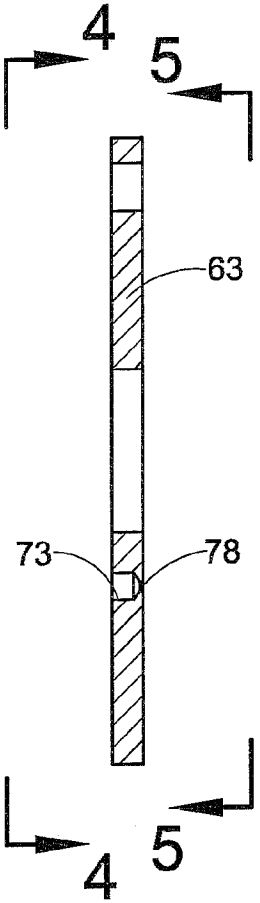
FIG. 3 is a cross sectional view of one of the plates used in the pressure compensation mechanism.
Figure 4:
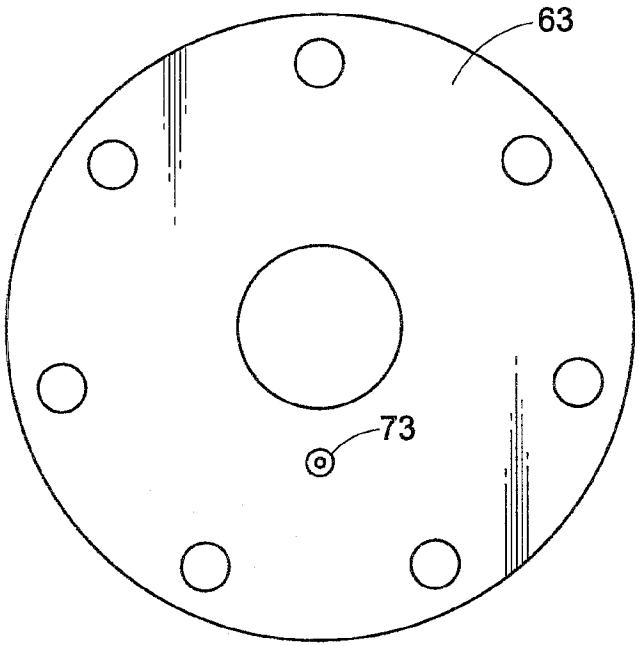
FIG. 4 is an end view of the first plate for the pressure compensating mechanism plate of FIG. 2 taken generally along lines 4-4 therein.
Figure 7:
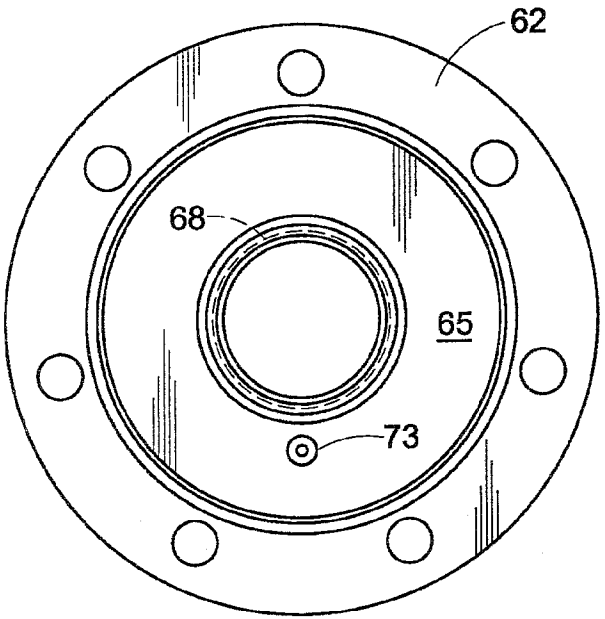
FIG. 7 is an end view of the plate of FIG. 6 taken generally along lines 7-7 therein.
Figure 6:
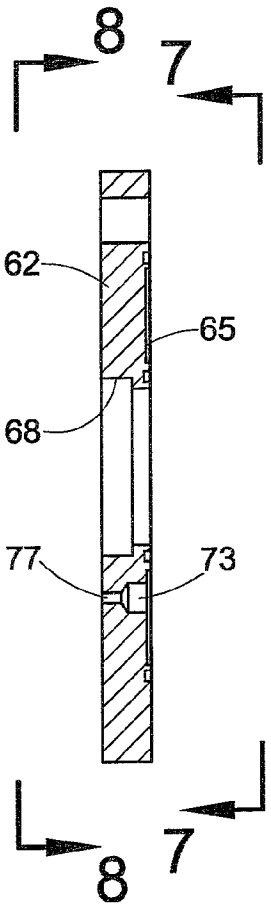
FIG. 6 is a cross sectional view like FIG. 2 of a further second plate for the pressure compensating mechanism.
Figure 8:
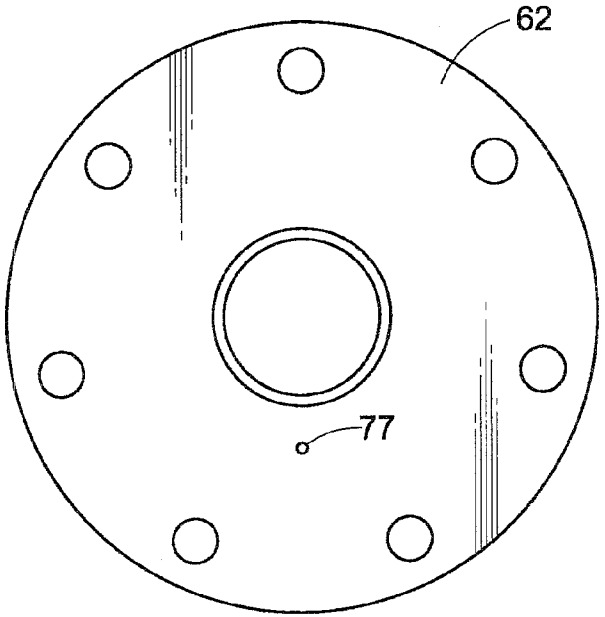
FIG. 8 is an end view of the plate of FIG. 7 taken generally along lines 8-8 therein.
Figure 11:
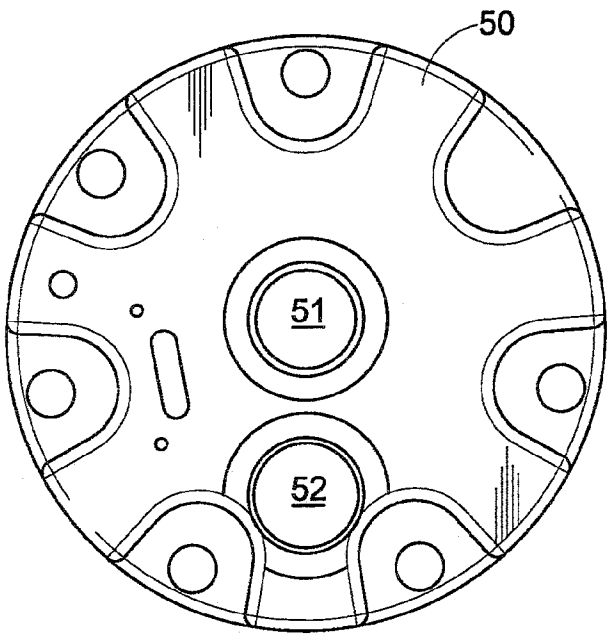
FIG. 11 is an end view of the end plate of FIG. 9 taken generally along lines 11-11 therein.
Figure 9:
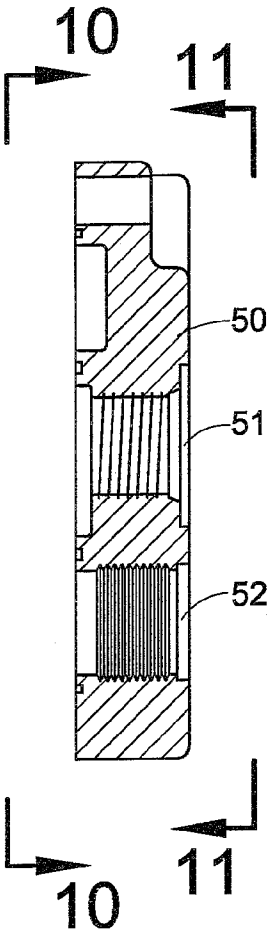
FIG. 9 is a cross sectional view of the end/port plate of the motor of FIG. 1, the end port plate is rotated 90° form the view of FIG. 1 for clarity.
Figure 10:
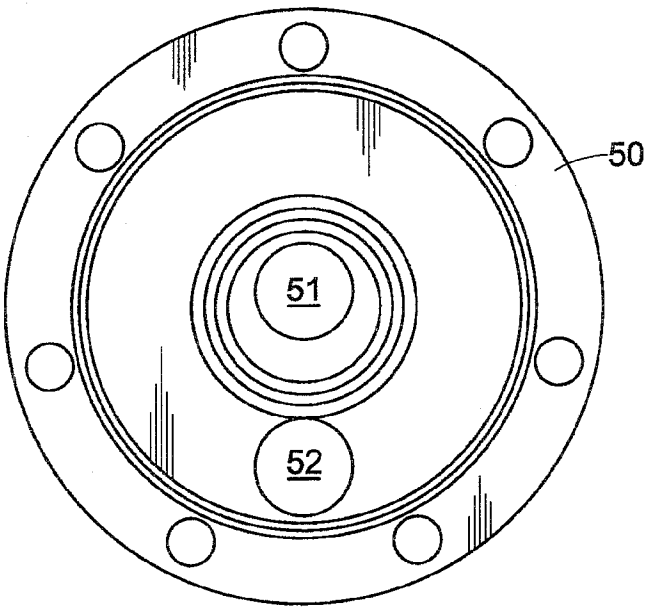
FIG. 10 is an end view of the end plate of FIG. 9 taken generally along lines 10-10 therein.
Figure 12:
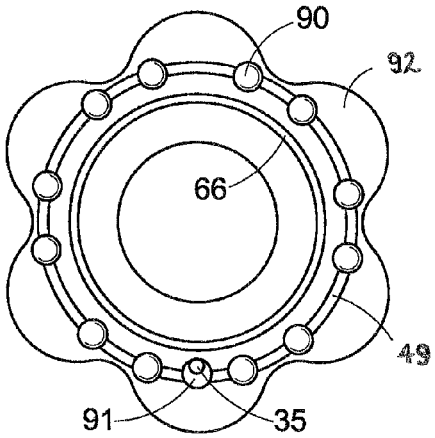
FIG. 12 is a side view of the rotor of FIG. 8 taken generally from its orbiting contact with the balancing mechanism of FIG. 1.

This invention relates to an improved hydraulic gerotor pressure device having an integral balancing mechanism. The invention will be described in its preferred embodiment of a gerotor motor having a valve integral with the rotor thereof. This device can be utilized as a motor or as a pump dependent upon the fluid and mechanical connection thereto. For clarity, it will be referred herein as a motor.

The gerotor pressure device itself includes a housing 10 having an integral bearing/mounting section 20, a gerotor set 30, a manifold 40, an end plate 50, and the balancing mechanism 60.

The bearing/mounting section 20 is utilized to affix the device to the frame of an associated device while, at the same time, allowing for the free rotation of the drive shaft 22 in respect thereto. The shape, mode of mounting, and type of drive shaft would depend upon a given particular application. This could include front mounting, concentric mounting, integral flange mounting, and end plate mounting, with the particular type of section 20 dependent upon the application intended for the device.

The gerotor set 30 is the main power generation system for the device.

The particular gerotor set 30 disclosed herein includes a stationary stator 31, an orbiting rotor 32, and a wobblestick 33.

The stator 31 of the gerotor set 30 defines the outer extent of the expanding and contracting gerotor cells 37 in addition to connecting the gerotor set 30 proper to the housing 10 of the device. The orbiting rotor 32 defines the interior dimension of the gerotor cells 37 based on the simultaneous orbiting and rotating motion of the rotor 32 in respect to the stationary stator 31. The hydraulic motor is operated by the relative pressure differential between radially displaced gerotor cells.

In the particular embodiment disclosed, the orbiting rotor 32 in addition serves as the main valve for the hydraulic device. The orbiting rotor 32 accomplishes this through an inner opening 55 and surrounding outer groove opening 56 to selectively interconnect the pressure and return ports through passages within the manifold 40 to the expanding and contracting gerotor cells 37 with the power applied between the orbiting rotor 32 and the rotating drive shaft 22 by the wobblestick 33. The interconnection is provided through these substantially concentric inner 55 and outer 56 valving passages in the rotor. This valving is preferred due to both its inherent structural and fluidic simplicity. The rotor valving disclosed, having pressure, return, and valving on a single side thereof, also has pressure imbalances that make it particularly suitable for incorporation of the invention disclosed herein. This type of valving with appropriate accompanying port passages is set forth in, for example, White U.S. Pat. No. 4,697,997; White U.S. Pat. No. 4,872,819; and, White U.S. Pat. No. 4,357,133, the contents of which are included herein by reference.

The manifold 40 serves to provide fluidic commutation to the inner 55 and outer 56 valving passages in the rotor 32 in addition to interconnecting such inner 55 and outer 56 valving passages to the expanding and contracting gerotor cells 37 as the device is operated. In the particular embodiment disclosed, the manifold 40 is of multiplate construction having selective portions of these critical passageways formed in a series of single cross sectional plates brazed together. This type of construction set forth in White U.S. Pat. No. 4,697,997 and White U.S. Pat. No. 6,257,853, the contents of which are included herein by reference.

The end plate 50 serves to physically retain the manifold 40 in place relative to the gerotor set 30 and the remainder of the housing 10. In addition, in the preferred embodiment disclosed, the end plate 50 serves as a physical location for the two ports 51, 52 which interconnect the pressure and return lines to the gerotor device. These ports may be axially as shown, or, with the thickness of the end plate 50 appropriately modified, could radially of the device. They could also be located in the bearing/mounting section 20 as in the U.S. Pat. No. 4,357,133 patent. A combination of end plate/mounting section ports could also be utilized. This provides for a flexible fluidic interconnection to the motor.

In order to increase the fluidic efficiency of the motor disclosed, one port 51 is interconnected to the central inner opening 55, which opening extends through the manifold 40, while the other port 52 is interconnected to the outer groove opening 56 in the rotor coaxial with the central opening 55. A radial seal surface of the rotor 32 and the manifold 40 between the central inner opening 55 and the outer groove opening 56 provides a face seal to resist the transfer of pressurized fluid therebetween.

In order to allow as large a central inner opening 55 as is practical, a flange 34 is included in the outer circumferential edge of the wobblestick 33 and a groove 68 is included in the housing of the motor 10. These combine to locate the outer end 36 of such wobblestick. In the embodiment disclosed, this location is in respect to both the rotor 32 and the inner edge 43 of the manifold 40. The former provides for a constant pressure angle and subscribed circle between the teeth of the wobblestick 33 and rotor 32. The latter, in addition, holds the wobblestick from passing substantially over the plane 44 of the center opening in the manifold 40, thus to retain the wobblestick 33 in position against the forces of fluid passing thereover. There is no physical contact between the wobblestick 33 and the inner edge 43 of the manifold. These reduce wear of the manifold (and thus reduce incidental containments in the hydraulic fluid) while allowing a relatively uncomplicated end plate (no integral wobblestick location mechanism). This is of particular interest when the port 51 in the end plate 50 located along the axis of the device is utilized as a return port. The flange also allows for the oversized commutation from the central opening 55 to the port 51. The size of the hole through the center of the manifold 40 can be as large as otherwise possible without any consideration of the effect of the wobblestick.

The balancing mechanism 60 is designed to increase the fluidic efficiency of the device by facilitating the axial containment of the longitudinal opposed ends 38, 39 of the expanding and contracting gerotor cells 37 of the device.

The particular balancing mechanism 60 disclosed includes two plates or disks 62, 63, a pressure chamber 65, and a shuttle valve 70.

The first plate 62 serves as a reaction plate in order to provide a solid surface for one side of the pressure chamber 65 of the balancing mechanism. To accomplish this, the plate has to have sufficient thickness in order to prevent its deformation from either the thrust bearing 24 on one side or the pressure chamber 65 on the other. Note that due to the containment of hydraulic pressure within the device, especially when the opening 52 therein is subject to high pressure, a purpose of the thrust bearing 24 is to further support the inner edge of the plate 62 (through the longitudinal length of the expanded section 25 of the drive shaft 22 and a second bearing 28 to the mounting section 20 in the embodiment disclosed).

Note that in the embodiment disclosed the groove 68 is located on the inner edge of the plate 62 cooperates with the flange 34 on the outer edge 35 of the wobblestick 33 in order to retain the wobblestick within the device as previously described. This reduces the cost of this function by providing the groove 68 in a surface which is easily amenable to a cast or machined surface.

The second plate 63 provides the main balancing function for the balancing mechanism 60. The plate 63 provides this by flexing due to the pressure in the pressure chamber 65, thus to press against the adjoining end 39 of the expanding and contracting gerotor cells 37. Physical pressure is also provided through the width of the rotor 32 on the other end 38 of the gerotor cells 37 against the manifold 40. This action retains the pressure in the gerotor cells against fluidic leakage along both axial end surfaces of the orbiting rotor 32. This increases the fluidic efficiency of the motor 10. This can be substantially 99% in the embodiment disclosed. In addition, due to the fact that the preferred embodiment disclosed has valving in the rotor with attendant possible pressurization of the outer valving groove 56, the plate 63 in addition aids in the compensation for this further imbalance as herein set forth.

In order to provide the hydraulic force for the valving mechanism 60, a pressure chamber 65 is located between the two plates 62, 63. Two seals 67, 69 define the inner and outer confines of a single circumferential pressure chamber 65. In the embodiment disclosed, most of the pressure chamber 65 itself has a depth, a spacing between the two plates 62, 63. This depth hastens the operation of the balancing mechanism by facilitating fluid access across its entire width. This also provides for a relatively uniform operation.

In order to efficiently interconnect this pressure chamber 65 to a source of high pressure, a shuttle valve 70 is located in respect to the chamber of the balancing mechanism 60. This shuttle valve 70 connects/disconnects simultaneously for differing relative fluid pressurizations. In the embodiment disclosed, this shuttle valve 70 includes a cavity 73 extending between a first opening 77 and a second opening 78 with a self contained shuttle ball 80.

The first opening 77 of the cavity 73 is interconnected through the device to one port 51, while a second opening 78 is interconnected through the device to the other port 52 of the device.

In the preferred embodiment disclosed, the interconnection of both is accomplished through the rotor. The first opening 77 is fluidically interconnected to the central opening 26 of the device (and thus port 51), while the second opening 78 is interconnected via a groove 39 on one side of the rotor, which connects over and through a passage 35 and the outer concentric valving groove 56 in the orbiting rotor through the manifold 40 to the other port 52. Small additional dimples 90 at the root of the rotor lobes 80 on the adjoining surface synergistically facilitate this commutation by expanding the relative width of the groove 39 at certain locations about the circumference of the rotor.

Due to these interconnections, relative pressure is available at one of the first opening 77 or second opening 78 at the pressurization of the respective port. This relative pressure in turn moves the ball 80 in the cavity 73 between the opposing ends thereof. The ball 80 in the cavity 73 is itself of such a size to allow for its motion in respect to the two plates 62, 63 while also allowing for it to relatively fluidically seal one of the two openings 77, 78 in respect to the other 78, 77. This is accomplished through the use of two smaller seats 82, 83 in the embodiment disclosed. The shuttle valve 70 is thus free to reciprocate back and forth in the cavity 73 while fluidically sealing the first opening 77 or second opening 78 having less relative pressure respectively. Since the cavity 73 is itself in co-extensive cross section with the pressure chamber 65 between the plates, this pressure interconnection in turn pressurizes the pressure chamber 65 to physically bow the plate 63 against the rotor, thus to provide the balancing function of the mechanism 60. Seals 67, 69 define the inner and outer extent of fluid pressurization.

Note that due to the utilization of a single ball 80 within a unitary cavity 73 reciprocating between two seats at the opposing ends thereof, the balancing function is provided with a simple mechanism suitable for construction of a flat plate on a drill press. The device is thus much simpler and more reliable than alternate construction such as that found in the devices set forth in the Background section herein. Further flow induced chattering of the balancing valve is reduced if not eliminated for a constant direction motor. Further fluid is not trapped within the pressure chamber 65. Fluid is free to flow from the cavity 73 as well as into such cavity. In addition, the balancing mechanism will operate at low RPM's without cogging and/or spiking. The seats 82, 83 in the preferred embodiment facilitate this operation. Preferably the depth of the cavity 73 on either side of the pressure chamber 65 is from 50% to 100% of the diameter if the ball 80 with the diameter of the cavity 73 being from 105% to 125% of the diameter of the ball 80. The length of the two openings 77, 78 is restricted primarily by the destruction strength of the plates 62, 63 at the minimum and by the degree of flexing of the plate 63 at the maximum.

Dimples 90 on the face of the preferred embodiment on the rotor aid in commutation to the opening 78 by synergistically expanding the relative diameter of the outer groove 39 for commutation with the opening 78. In the preferred embodiment disclosed, this further allows the relative cross section of the groove 39 to sweep over the opening 78 for better commutation therewith (adding two contacts for each eccentricity in the embodiment shown). This facilitates direct commutation through a greater number of degrees of rotation than the unadorned simple groove 39 would provide to a simple hole 78. This further aids to commutation to the opening 78 could be provided, for example, by including multiple shuttle valves having differing relative phase relationships to the rotor 32. Another enhancement would be to provide a star-shaped groove to facilitate commutation similar to U.S. Pat. No. 4,872,819 FIG. 16. These modifications may be appropriate under low speed, high torque, fast cycling, and/or direction reversing operations. This is particularly advantageous at slow RPM and/or drastic pressure differentials by causing the connection to the opening 78 to be updated quicker and at less shaft rotation than otherwise (to within 10% to 15% in the embodiment disclosed). The inner groove 66 is pressurized along the face of the rotor by residual fluid passage from higher to lower pressure therealong. This groove 66 thus has relatively high pressure at all times. This further aids in the pressurization of opening 78

Figure 13:
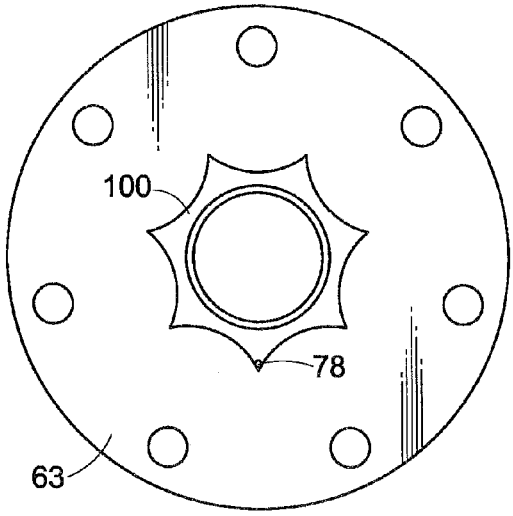
FIG. 13 is a view like FIG. 8 including a commutation groove.
Figure 14:
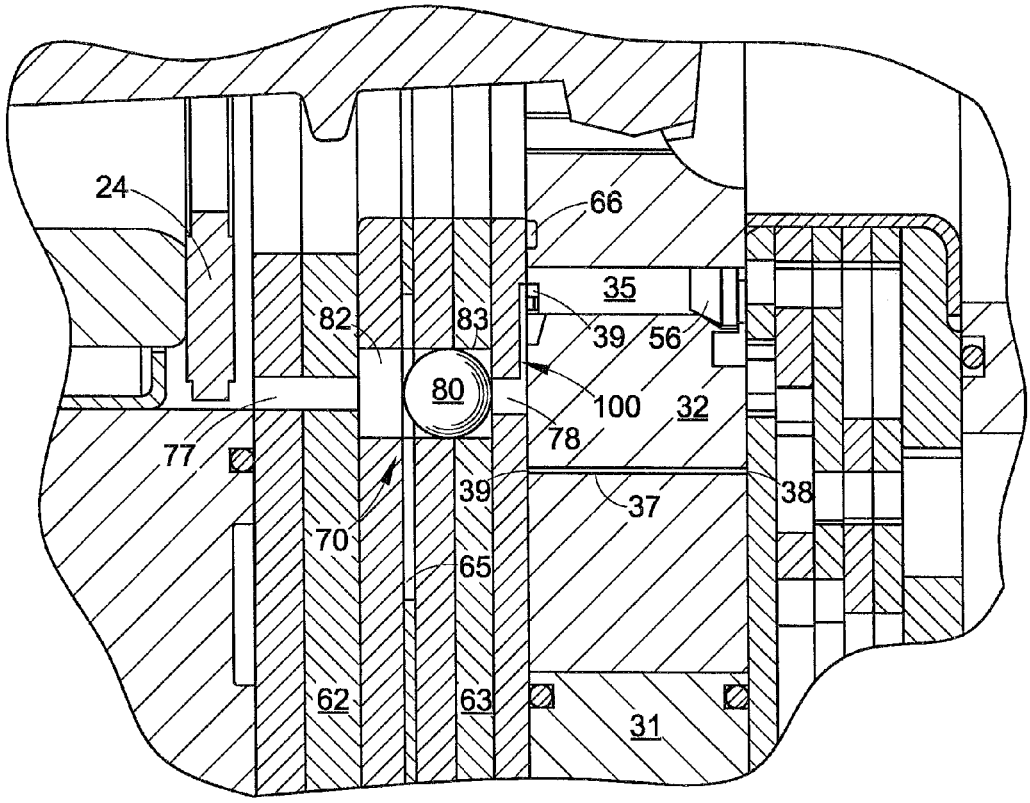
FIG. 14 is a view like FIG. 2 of a balancing mechanism of sequential plate construction.

The balancing mechanism can be modified. An example is shown in FIG. 13 wherein a groove 100 is laser etched onto the surface of the plate 63 adjoining the rotor 32 in order to provide known commutation to the opening 78 throughout the full orbit of the rotor. This modification would be especially suitable in a sequential plate balancing mechanism (FIG. 14). In this figure the plates 62, 63 have been replaced with various thickness stamped plates. The seals 67, 69 have been replaced by a brazing operation connecting adjacent plates at the inner and outer edges thereof. Caps such as shown on the inner edge of the manifold would allow for an enlarged chamber 65. Note that with a suitable hardness differentiation between the shuttle ball 80 and the seats 82, 83, the seats 82, 83 shown would self form to the ball.

The particular preferred balancing mechanism 60 disclosed is substantially 4.9" in diameter and 0.7" thick. The first plate 62 itself is 0.42" thick while the second plate 63 is 0.28" thick. This 150/100 ratio is preferred recognizing that plate 63 provides for the flexing for the pressure chamber. (Note that the bending differential could also be provided by using differing materials, modulus hardness, and/or reinforced materials.) This is within the preferred range from 125/100 to 175/100 that in the preferred embodiment provides the desired performance. The pressure chamber 65 has an outer radius of 1.7", an inner radius of 0.88", and a depth of 0.03". The inner seal 67 has a 0.81" outer radius, while the outer seal 69 has a 1.8" inner radius. Having the pressure chamber 65 in a single plate simplifies manufacture. The diameter of the chamber is selected to substantially overlap both the minimum (rotor bottom dead center) and maximum (rotor top dead center as shown in FIG. 1) radius of the expanding and contracting gerotor cells. (Note that while in the preferred embodiment disclosed, these radii substantially center the pressure chamber 65 in respect to the inner ends 37, 38 of expanded gerotor cells, the presence of bolt 27 and stator 31 makes the outer radius less important than the inner radius by reducing the flexing of plate 62 thereat. The thrust bearing 24 provides a further support for plate 62 against flexing due to the pressurization of cavity 65.) The cavity 73 is 0.22" in diameter with the ball 80 approximately 0.214" in diameter and seating against seats 82, 83 spaced 0.025" on opposing sides of the planar surface between the two plates 62, 63. The two openings 77, 78 are 0.078" in diameter located 1.1" from the longitudinal axis of the motor 10. The seats for the ball 70 are polished.

The rotor 32 has two grooves 39, 66. The first groove 39 is connected as set forth through the passage 35 and groove 56 to the port 52. The groove 39 is 0.078" wide centered 0.977" from the centerline rotational axis of the rotor with the other groove 66 is 0.071" wide centered 0.854" from the rotational axis of the rotor. The hole 35 extends between the grooves 39 and the valving commutation groove 56 spaced 1.01" from the rotor centerline with a diameter of 0.125". The dimples 34 are 0.22" in diameter 0.03" deep located adjoining the two sides of the valleys at the root of the rotor lobes 92, with the passage 35 centered in an additional asymmetric dimple 91 between two adjoining dimples 90.

Note that in the rotor valved preferred embodiment, the balancing mechanism 60 is interchangeable with a plain wear plate not incorporating the balancing mechanism in an otherwise substantially identical device. This gives a manufacturer/user the option of incorporating the balancing mechanism or not without alterations to the remainder of the device 10 (a wear plate could be a single plate of an otherwise appropriate thickness without the cavity 73 or ball 80). This simultaneously increases the adaptability of a single device while maintaining a lower supply/service inventory. A balancing mechanism can also be retrofitted to an existing installation. In the embodiment disclosed, the fact that the bolts 27 are not bottomed out with the balancing mechanism in place allows for a variety of differing mechanisms and/or plates in a single unit.

Note also that the balancing mechanism can be incorporated into gerotor motors having rotor imbalances of differing quality. For example, gerotor motors include the White Rotary Valve in U.S. Pat. No. 6,074,188 or the Orbiting Valve in U.S. Pat. No. 5,135,369, the contents of which are incorporated by reference.

The flange 34 on the wobblestick 33 extends 0.23" off of the outer surface 35 of the wobblestick with sides angled at substantially the same angle the longitudinal axis of the wobblestick forms with the longitudinal axis of the device (10° in the embodiment disclosed). The groove 68 has a diameter of 1.5" and a depth of 0.25". The distance between the outer edge of the groove 68 to the inner plane of the manifold is substantially equal to that of the outer edge of the flange 34 to the end of the wobblestick 33 (1.5" in the embodiment disclosed).

Although the invention has been described in its preferred embodiment disclosed, it should be understood that changes, alterations, and modifications may be had without deviating from the present invention as hereinafter claimed.

For example, the balancing mechanism could have differing size openings 77, 78 in order to vary the response time of the shuttle ball in recognition that the pressurization of the groove 56 provides more imbalance than pressurization of the central opening 55 of the rotor. For an additional example, the stamping of plates could be modified from the punch through design of FIG. 14 to provide conical ball seats.

Other changes are also possible.

The invention claimed is:

1. In a hydraulic device utilizing rotor valving with inner and outer commutation grooves in an orbiting rotor interconnecting two ports to expanding and contracting gerotor cells through a stationary manifold in the housing on pressurizing one side of the rotor away from the manifold, the improvement of a pressure compensation mechanism, said pressure compensation mechanism including a balancing plate, said balancing plate being connected to the housing between the rotor and the housing on the other side of the rotor than the manifold, said balancing plate having a pressure chamber, a shuttle valve compartment, said shuffle valve compartment being fluidically connected to said pressure chamber, said shuffle valve compartment having two openings, said two openings being connected to the two ports respectively, a shuttle valve, said shuttle valve being in said shuttle valve compartment, said shuttle valve being moveable within said compartment to seal one of said two openings upon relative pressurization of the other of said two openings to provide for the pressurization of said pressure chamber and thus pressure compensation for the device.

2. The pressure compensation mechanism of claim 1 characterized in that said balancing plate includes two individual adjoining disks with the pressure chamber therebetween.

3. The pressure compensation mechanism of claim 2 characterized in that one of said two openings of the shuttle valve compartment is in one of said two disks with the other of said two openings of the shuttle compartment being the other of said two disks.

4. The pressure compensation mechanism of claim 1 characterized in that one of the two ports connects to one of said two openings of the shuttle compartment through the inner commutation groove.

5. The pressure compensation mechanism of claim 1 characterized in that one of the two ports connects to one of said two openings through the outer commutation groove.

6. The pressure compensation mechanism of claim 1 wherein the hydraulic device has an end plate and characterized in that both of the two ports are in the end plate and the stationary manifold is adjacent to the end plate.

7. The pressure compensation mechanism of claim 2 characterized by the addition of a seal between said adjoining disks inside said pressure chamber.

8. The pressure compensation mechanism of claim 2 characterized by the addition of a seal between said adjoining disks outside said pressure chamber.

9. The pressure compensation mechanism of claim 4 wherein the hydraulic device has a thrust bearing for its rotating shaft and characterized in that one port opening connection is through the thrust bearing.

10. The pressure compensating mechanism of claim 5 characterized by the addition of dimples, said dimples being in the rotor adjoining the outer commutation groove, and said dimples sweeping over said one of said two openings.

11. The pressure compensating mechanism of claim 1 characterized in that said pressure chamber has a radial extent and the cross section of said shuttle valve compartment intersecting said radial extent of said pressure chamber.

12. The pressure compensating mechanism of claim 10 wherein the rotor has lobes with valleys and characterized in that said dimples are located in pairs at the valleys at the root of the rotor lobes respectively.

13. The pressure compensating mechanism of claim 5 characterized by the addition of a further commutation groove for said one of said two openings.

14. The pressure compensating mechanism of claim 13 characterized in that said further commutation groove is of varying width.

15. The pressure compensating mechanism of claim 13 characterized in that said further groove is etched into one of said discs.

16. The pressure compensating mechanism of claim 1 characterized in that said balancing plate is of at least two sequential plates.

17. The pressure compensating mechanism of claim 16 characterized in that said at least two sequential plates are of single cross section respectively.

18. In a hydraulic device utilizing rotor valving with inner and outer commutation grooves in an orbiting rotor interconnecting two ports to expanding and contracting gerotor cells through a stationary manifold in the housing on pressurizing one side of the rotor away from the manifold, each of the inner and outer commutation grooves being fluidically connected to a port respectively, the improvement of a pressure compensation mechanism, said pressure compensation mechanism including a balancing plate, said balancing plate being connected to the housing between the rotor and the housing on the other side of the rotor than the manifold, said balancing plate having a pressure chamber, a shuffle valve compartment, said shuffle valve compartment being fluidically connected to said pressure chamber, said shuttle valve compartment having two openings, one of said two opening connecting through the inner commutation groove to one of the ports, the other of said two openings connecting through the outer commutation groove to the other of the ports, a shuffle valve, said shuffle valve being in said shuttle valve compartment, said shuttle valve being moveable within said compartment to seal one of said two openings upon relative pressurization of the other of said two openings to provide for the pressurization of said pressure chamber and thus pressure compensation for the device.

19. The pressure compensation mechanism of claim 18 characterized in that said balancing plate includes two individual adjoining disks with the pressure chamber therebetween.

20. The pressure compensation mechanism of claim 19 characterized in that one of said two openings of the shuttle valve compartment is in one of said two disks with the other of said two openings of the shuttle compartment being the other of said two disks.

21. The pressure compensating mechanism of claim 18 characterized by the addition of dimples, said dimples being in the rotor adjoining the outer commutation groove, and said dimples sweeping over said one of said two openings.

22. The pressure compensating mechanism of claim 18 characterized in that said pressure chamber has a radial extent and the cross section of said shuttle valve compartment intersecting said radial extent of said pressure chamber.

23. In a hydraulic device utilizing rotor valving with inner and outer commutation grooves in an orbiting rotor interconnection two ports to expanding and contracting gerotor cells through a stationary manifold in the housing on one side of the rotor, the improvement of a pressure compensation mechanism, said pressure compensation mechanism including two balancing plates, said balancing plates being connected to the housing between the rotor and the housing on the other side of the rotor than the manifold, said balancing plates defining a pressure chamber therebetween, said pressure chamber having a radial extent, a shuttle valve compartment, said shuttle valve compartment having a cross section fluidically connected to said pressure chamber, said shuttle valve compartment having two openings, said two openings being connected to the two ports through the inner and outer commutation grooves in the rotor for constant flow therebetween respectively, a shuttle valve, said shuffle valve being in said shuttle valve compartment, and said shuttle valve being moveable within said compartment to seal one of said two openings upon relative pressurization of the other of the two openings to provide for the pressurization of said pressure chamber and thus pressure compensation for the device.

24. The pressure compensation mechanism of claim 23 wherein the manifold has a central opening and characterized by the addition of a flange, said flange extending off of the outer surface of the wobblestick, a groove, said groove being in said housing surrounding the wobblestick, said flange engaging said groove to retain the wobblestick in position in respect to the plane of the opening in the manifold, and the opening in the manifold having a diameter greater than the diameter transcribed by the adjacent end of the wobblestick.

25. The pressure compensation mechanism of claim 23 wherein the housing has an end plate substantially perpendicular to the rotating axis of the input/output shaft and characterized in that the two ports are in the end plate.

* * * * *